US008082837B2

(12) United States Patent
Lea-Wilson

(10) Patent No.: US 8,082,837 B2
(45) Date of Patent: Dec. 27, 2011

(54) CONTROL SYSTEM FOR RECIPROCATING DEVICE

(75) Inventor: Mark Lea-Wilson, Edmonton (CA)

(73) Assignee: Plainsman Mfg. Inc., Edmonton, Alberta (CA)

( * ) Notice: Subject to any disclaimer, the term of this patent is extended or adjusted under 35 U.S.C. 154(b) by 608 days.

(21) Appl. No.: 12/203,497

(22) Filed: Sep. 3, 2008

(65) Prior Publication Data

US 2009/0071323 A1 Mar. 19, 2009

Related U.S. Application Data

(60) Provisional application No. 60/972,830, filed on Sep. 17, 2007.

(51) Int. Cl.
*F01L 29/06* (2006.01)
*F04B 53/10* (2006.01)

(52) U.S. Cl. ..... 91/303; 91/350

(58) Field of Classification Search ..... 91/218, 91/286, 303, 350, 358 R, 397, 398, 410, 462
See application file for complete search history.

(56) References Cited

U.S. PATENT DOCUMENTS

| | | | | |
|---|---|---|---|---|
| 2,590,014 | A * | 3/1952 | Ivanoff et al. | 91/350 |
| 4,770,205 | A * | 9/1988 | Jones et al. | 91/397 |
| 5,918,526 | A * | 7/1999 | Jauhola | 91/350 |
| 6,263,777 | B1 * | 7/2001 | Lauder | 91/350 |
| 6,862,972 | B2 * | 3/2005 | Morrison | 91/303 |

FOREIGN PATENT DOCUMENTS

| | | |
|---|---|---|
| CA | 2294410 | 1/2000 |
| CA | 2493340 | 2/2005 |
| CA | 2493340 A1 * | 8/2006 |

* cited by examiner

*Primary Examiner* — Thomas E Lazo
(74) *Attorney, Agent, or Firm* — Bennett Jones LLP

(57) ABSTRACT

A control system for a reciprocating device includes a switching valve, a toggle for operating the valve, a trigger associated with the reciprocating device to actuate the toggle, and biasing means disposed on the trigger for applying a biasing force to the toggle. The valve includes a first drive line, a second drive line, a fluid supply inlet and a fluid exhaust outlet. The valve switches between the first and second drive lines upon actuation of the toggle by the trigger, to switch direction of the reciprocating device.

6 Claims, 11 Drawing Sheets

PISTON ARRANGEMENT

DOUBLE ACTING DIAPHRAGM ARRANGEMENT

CONTROL SYSTEM FOR RECIPROCATING DEVICE

CROSS REFERENCE TO RELATED APPLICATIONS

This application claims the priority benefit of U.S. Provisional Patent Application No. 60/972,830 filed on Sep. 17, 2007 entitled "Control System for Reciprocating Device", the contents of which are incorporated herein by reference.

FIELD OF THE INVENTION

The present invention relates to a control system for a reciprocating device for use in such applications as reciprocating drives, reciprocating actuators, reciprocating pumps, reciprocating power generators and other reciprocating devices commonly powered by fluid power.

BACKGROUND

Canadian Patent CA 2294410 (Lauder) and Canadian Patent Application CA 2493340 (Day) describe operational difficulties experienced by state of the art reciprocating devices used to power chemical injection pumps on oil and gas wells. At low operating speeds and low operating pressures, the reciprocating devices can stall and become stuck as the operating valve passes through the middle position. Lauder describes a solution for the reciprocating devices that utilizes fluid pressure to move the device in a first direction and a spring to move in it in a second direction. Day describes a similar device adapted to move the device in both the first and second directions using fluid power.

SUMMARY OF THE INVENTION

In one aspect, the invention comprises a control system for a reciprocating device, the control system comprising:

(a) a switching valve having a fluid supply inlet, an exhaust outlet, a first drive line, and a second drive line, wherein the valve is operable to connect one of the exhaust outlet and the fluid supply inlet to the first drive line and to connect one of the exhaust outlet and the fluid supply inlet to the second drive line, (b) a toggle for operating the valve, wherein the toggle is movable between a first position in which fluid flow is from the fluid supply inlet to the first drive line, and from the second drive line to the exhaust outlet, and a second position in which fluid flow is from the fluid supply inlet to the second drive line, and from the first drive line to the exhaust outlet;

(c) a reciprocating device that is operable to move in a first direction due to fluid pressure in the first drive line and a second direction opposite the first direction due to fluid pressure in the second drive line;

(d) means for actuating the toggle associated with the reciprocating device, said actuation means being operable to move the toggle into the first position when the reciprocating device is moving in the second direction and to move the toggle into the second position when the reciprocating device is moving in the first direction; and wherein said actuation means comprises first biasing means to apply a biasing force to the toggle when the reciprocating device is moving in the first direction and second biasing means to apply a biasing force to the toggle when the reciprocating device is moving in the second direction, wherein the first and second biasing means store energy while moving in the first and second directions respectively, to force the toggle through a middle position between its first and second positions.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION OF PREFERRED EMBODIMENTS

The present invention relates to a control system for a fluid-driven reciprocating device. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

Figure 1:
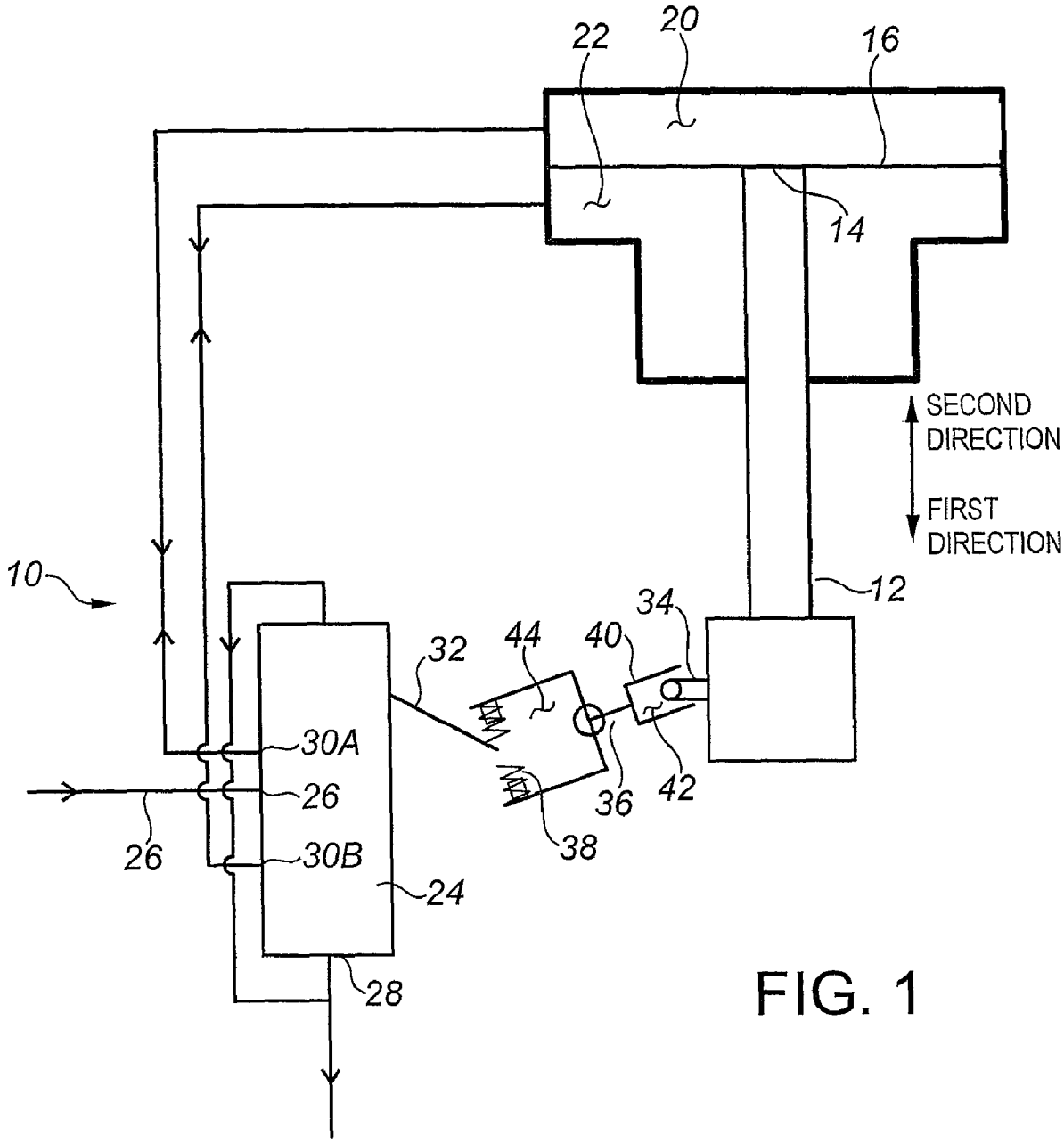
FIG. 1 is a schematic view of one embodiment of the present invention.

In one embodiment shown schematically in FIG. 1, the invention comprises a control system (10) for a reciprocating device. The reciprocating device has a linearly reciprocating shaft (12) which reciprocates between a first direction and a second direction opposed to the first direction. The first end (14) of the shaft is connected to a platen (16). The platen (16) divides a fluid retaining chamber thereby defining a first chamber (20) and a second chamber (22). The platen (16) is moveable within the fluid retaining chamber, thereby varying the proportionate volume of the first and second chambers (20, 22). In alternative embodiments, the platen may be replaced by a flexible diaphragm, a piston or the like.

The control system (10) includes a switching valve (24) having a fluid supply inlet (26), an exhaust outlet (28) and a plurality of driveline ports (30). The valve (24) is operable to connect either the exhaust outlet (28) or the fluid supply inlet (26) to one of the driveline ports (30). In one embodiment, a plurality of exhaust outlets (28) may be provided.

Figure 2A:
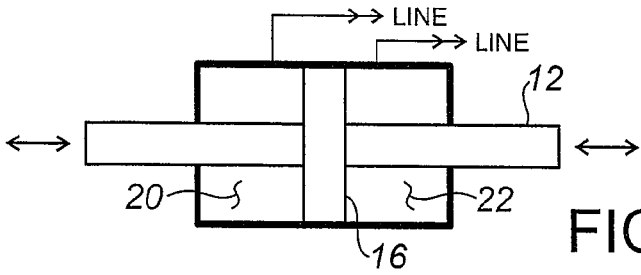
FIGS. 2A, 2B, 2C and 2D show alternative variations of the reciprocating device.
Figure 2B:
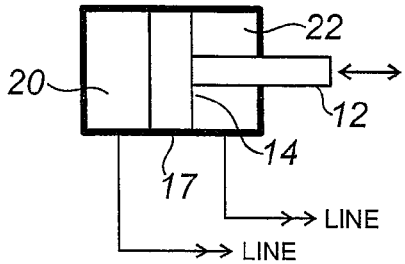
Figure 2C:
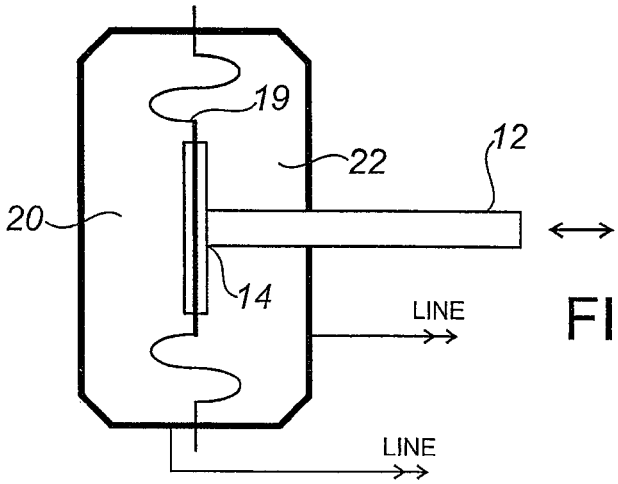
Figure 2D:
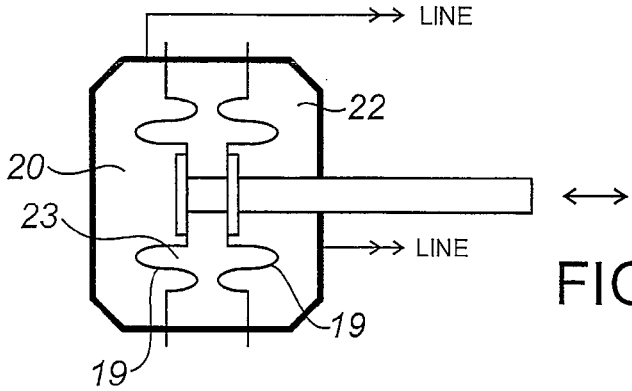

In one embodiment, the first end (14) of the shaft (12) may be connected to a piston (17), as shown in FIG. 2B, which divides a cylinder into a first chamber (20) and a second chamber (22), both of which chambers are connected to the switching valve (24) as described above. In another embodiment, the first end (14) of the shaft (12) may be connected to a double-acting diaphragm (19), which again divides a fluid chamber into a first chamber (20) and a second chamber (22), as shown in FIG. 2C. In one embodiment, at least one intermediate chamber (23) may be provided between a pair of double-acting diaphragms (19), as shown in FIG. 2D.

The nature of the fluid chamber, and the means for actuating reciprocating motion of the shaft (12) is not an essential part of the present invention. Various alternative means will be apparent to those skilled in the art to translate fluid pressure from the valve (24) into reciprocating movement of the shaft (12). Furthermore, the reciprocating motion controlled by the valve (24) need not be linear.

Figure 5:
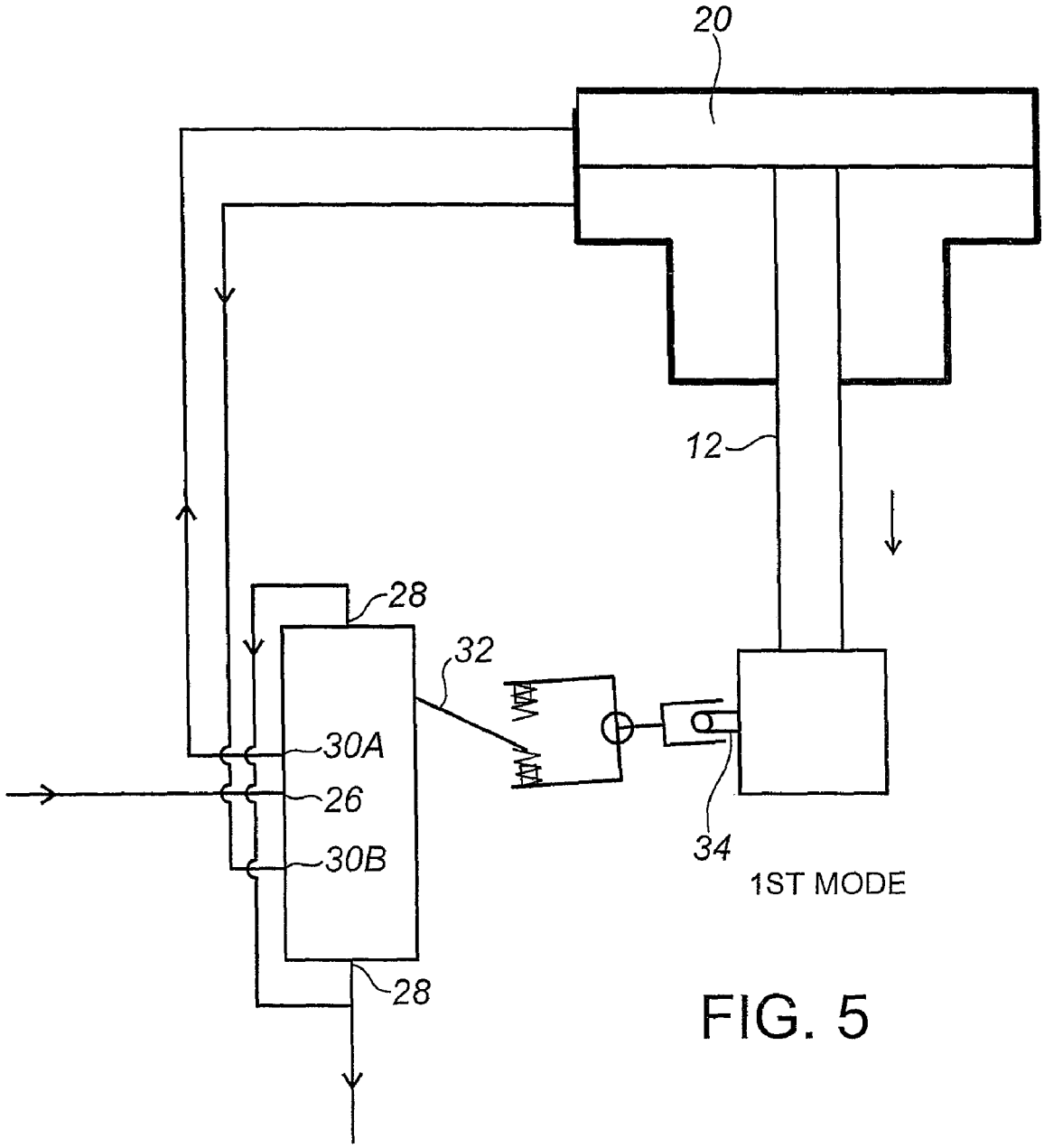
FIG. 5 shows a schematic of one embodiment of the invention where the reciprocating device is moving in a first direction.

The valve (24), when in a first position illustrated in FIG. 5, provides fluid communication from the fluid supply inlet (26) to a first driveline port (30A) that is connected to supply fluid to the first chamber (20), causing the shaft (12) to move in the first direction. The exhaust outlet (28) is connected to a second driveline port (30B) that provides fluid communication between the second chamber (22) and the exhaust outlet (28).

Figure 6:
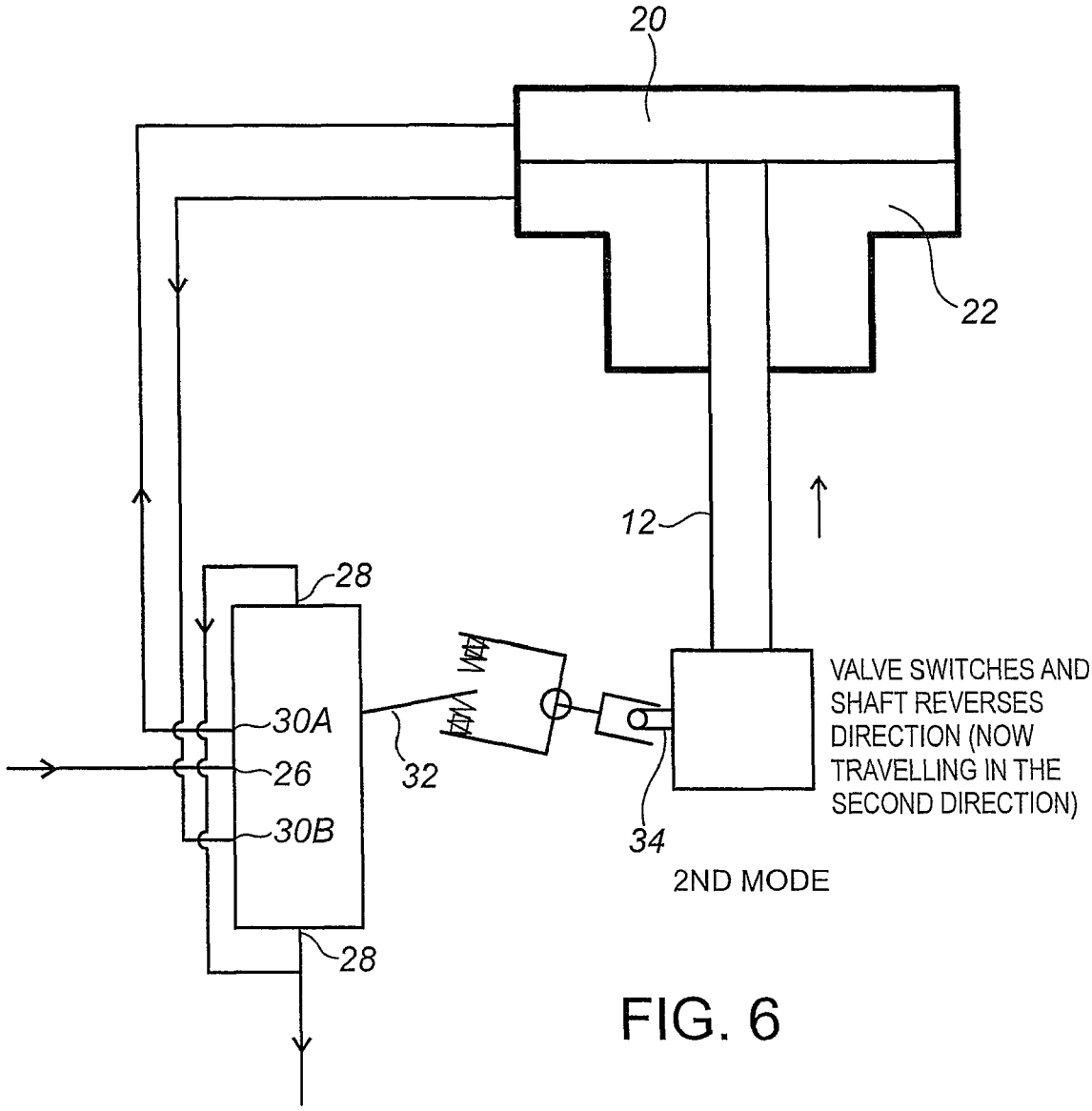
FIG. 6 a schematic of one embodiment of the invention where the reciprocating device is moving in a second direction.

The valve (24), when in a second position illustrated in FIG. 6, connects the fluid supply inlet (26) to the second driveline port (30B), providing fluid communication with the second chamber (22). The exhaust outlet (28) in the second position is connected to the first driveline port (30A), providing fluid communication between the first chamber (20) and the exhaust outlet (28).

As the shaft moves in either the first direction or the second direction, means are provided to change the position of the valve as a result of movement of the shaft. In one embodiment, such means comprise a physical connection between the shaft and a valve control member.

In one embodiment, the valve control member comprises a toggle (32) for operating the valve (24). The toggle (32) is movable between a first position and a second position by movement of the shaft (12), for example linear movement. When the toggle (32) is in its first position, the valve is in its first position, and the second position of the toggle corresponds to the second position of the valve. In one embodiment, actuation means associated with the reciprocating device, such as a trigger (34) on the reciprocating device, moves with the reciprocating shaft (12) and a connector (36) is disposed between the trigger (34) and the toggle (32). The connector (36) is operable to move the toggle (32) into the second position when moving in the first direction and to move the toggle (32) into the first position when moving in the second direction. In an alternative embodiment, the trigger may directly contact the toggle, without the use of a connector.

In one embodiment, the connector (36) includes biasing means such as springs (38) arranged to transmit forces to the toggle (32) when the trigger (34) is moving in the first and the second direction. In effect, the springs (38) store energy while moving in the first and second direction to force the toggle (32) through the middle position, preventing the toggle from being stuck in the middle position. In one embodiment, the springs (38) are arranged on the connector (36) such that the toggle (32) is continuously in contact with at least one spring (38), thereby preventing foreign object interference with the operation of the control system.

In one embodiment, the connector (36) comprises a pivoting member (40) which has a trigger opening (42) for receiving the trigger (34) and a toggle opening (44) for receiving the toggle (32). The pivoting member comprises a pair of toggle actuating arms which defines the toggle opening (44). The pivoting member (40) is mounted to a mounting bracket (41) which is itself mounted to the valve (24) housing.

In one embodiment, the springs (38) are located on the toggle actuating arms adjacent the opening (44) for receiving the toggle (32). The trigger opening (42) is preferably on a side of the pivoting member (40) opposite to the toggle opening (44). The pivot point (43) is preferably disposed between the toggle opening (44) and the trigger opening (42).

Figure 3:
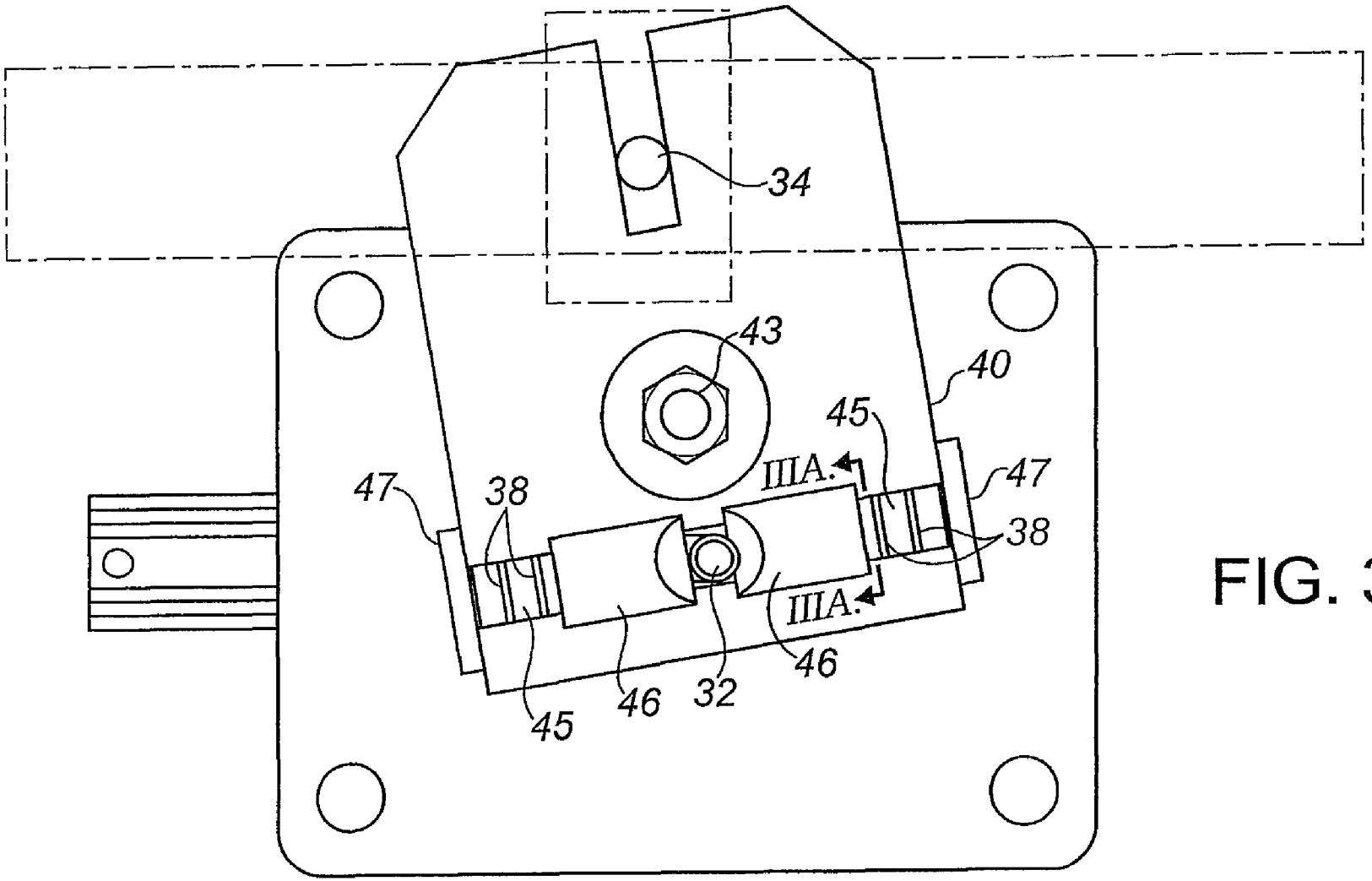
FIG. 3 shows a view of the actuating means of one embodiment.
Figure 3A:
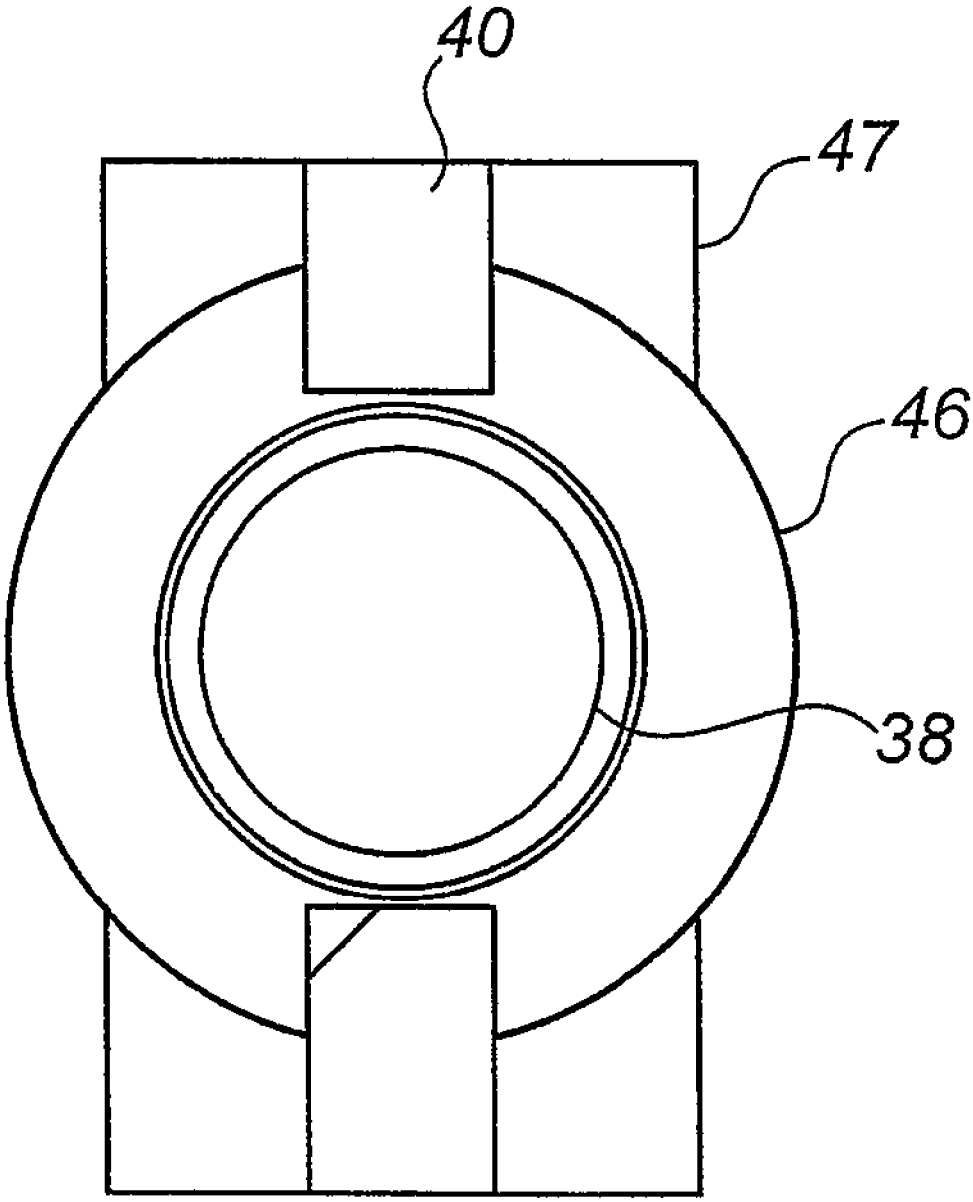
FIG. 3A shows views of the biasing means on the actuating means.
Figure 4:
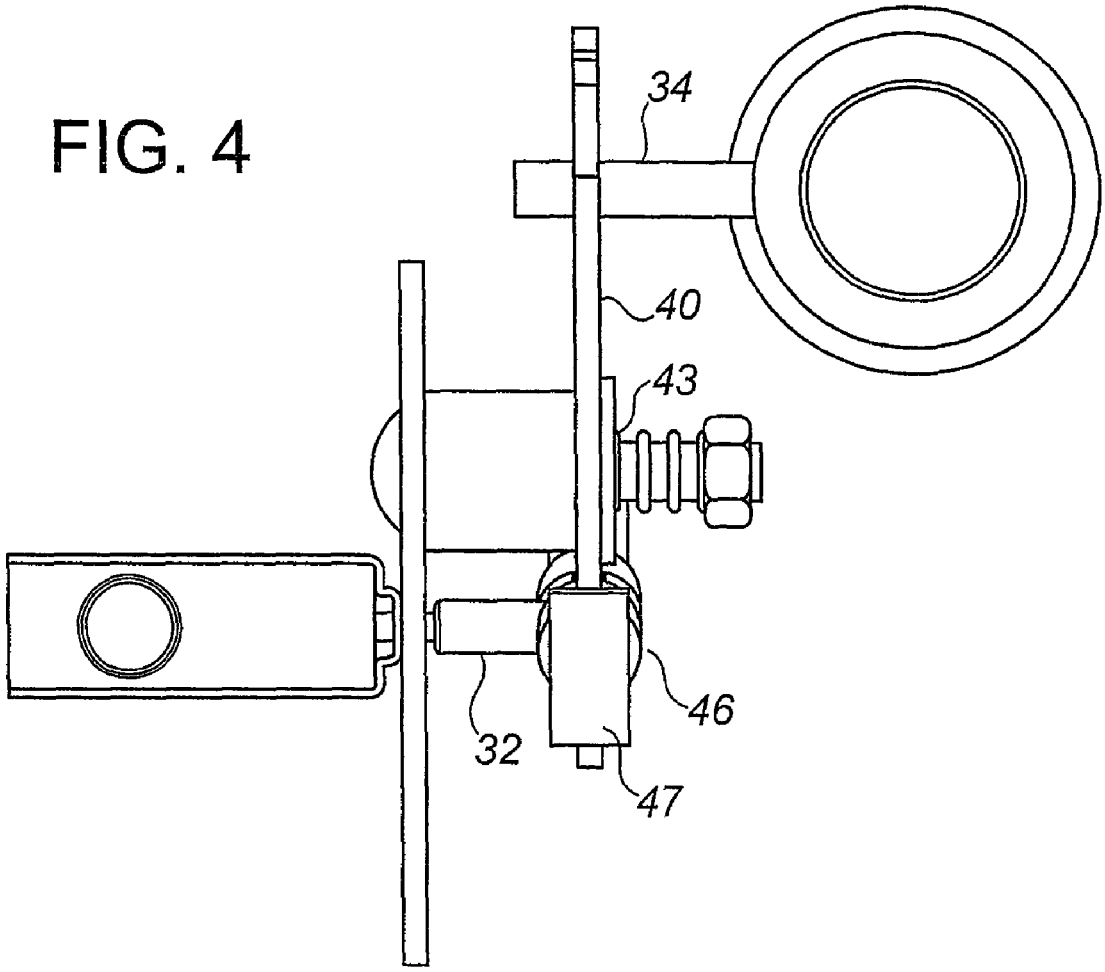
FIG. 4 shows an end view of the embodiment of FIG. 3.

In one embodiment, as shown in FIGS. 3, 3A and 4, the springs (38) are preferably housed in a slot (45) in the pivoting member (40), secured on one end by a terminal block (47) and by sliders (46) on the opposing end. The sliders (46) may slide back and forth along the slot (45). In one embodiment, the springs (38) and sliders (46) are arranged such that at least one slider (46) is in contact with the toggle (32) at all times.

Accordingly, in one embodiment, as the shaft moves in the first direction, as a result of the valve (24) being in the first position, the trigger (34) actuates the pivoting member (40), causing it to rotate in a clockwise direction in FIG. 5. The pivoting member (40) thus actuates the toggle (32) by means of a spring and slider (46). The slider (46) contacts the toggle and the spring (38) compresses, until the force of the spring (38) is sufficient to move the toggle (32) into its second position, thereby causing the valve (24) to move to its second position, as shown in FIG. 6.

From the second position, the valve (24) causes fluid to accumulate in the second chamber (22), causing the shaft to move in the second direction. As the shaft moves in the second direction, the trigger (34) actuates the pivoting member (40), causing it to rotate in a counter-clockwise direction in FIG. 6. The toggle opening (44) thus actuates the toggle (32) by means of a spring and slider (46). The slider (46) contacts the toggle and the spring (38) compresses, until the force of the spring (38) is sufficient to move the toggle (32) into its first position, thereby activating the first position of the valve (24), shown in FIG. 5.

Thereafter, the valve periodically reverses between its first and second positions, causing the shaft to reciprocate between its first and second directions.

Figure 7:
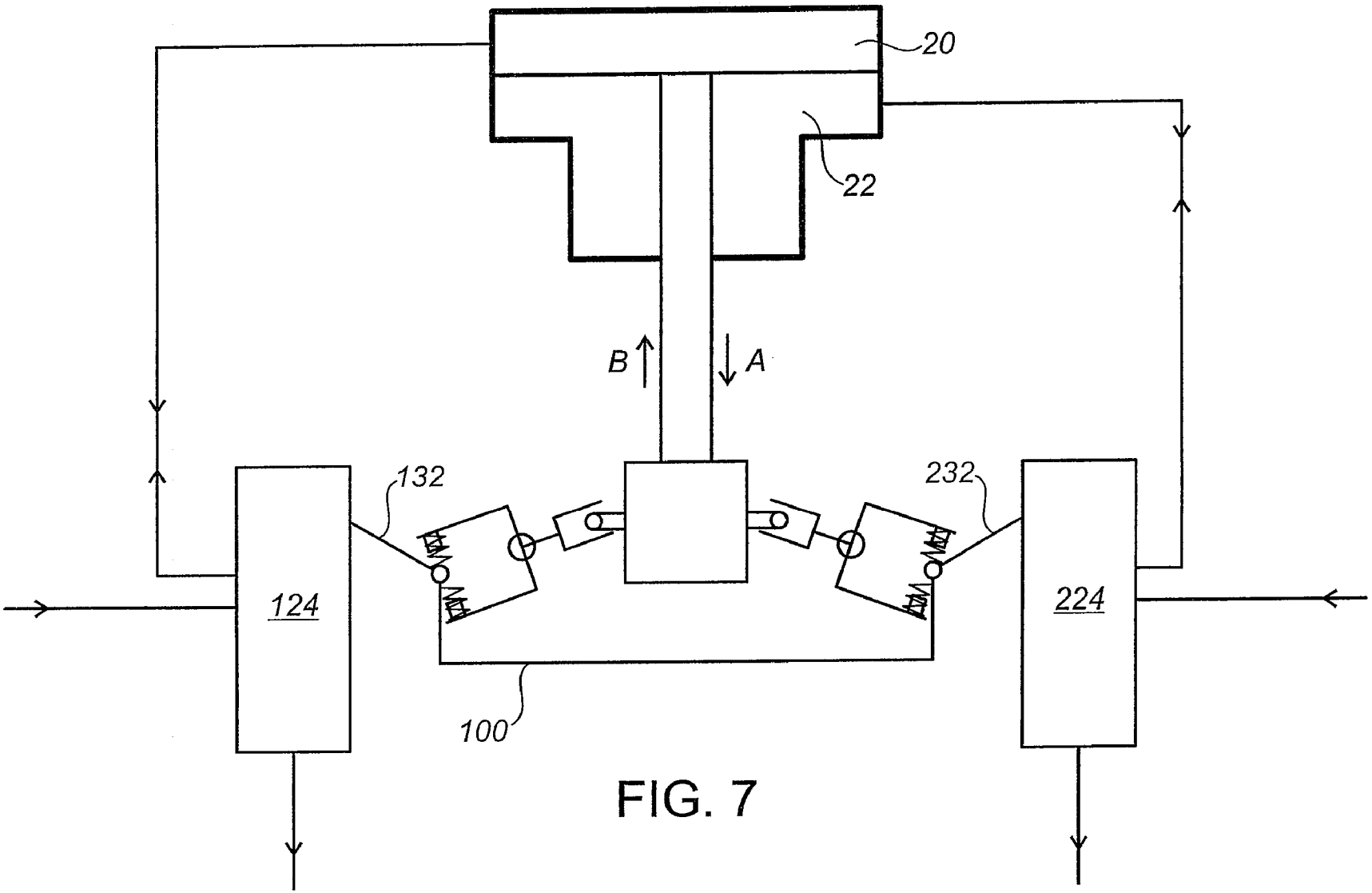
FIG. 7 shows a schematic of an alternative embodiment employing dual valve units.

In one embodiment, two or more valves (24) may be provided to control the reciprocating device. As shown in FIG. 7, one toggle (132) may actuate a 3-way valve unit (124) which connects the first chamber (20) to the fluid supply inlet (26), while a second toggle (232) actuates a second 3-way valve unit (224) which connects the second chamber to a fluid supply inlet. Thus, the first valve (1.24) will operate move the shaft (12) in the first direction (arrow A), while the second valve (224) operates to move the shaft in the second direction (arrow B). In one embodiment, the two toggles (132, 232) are mechanically linked (100) to ensure that they move in unison.

Figure 8B:
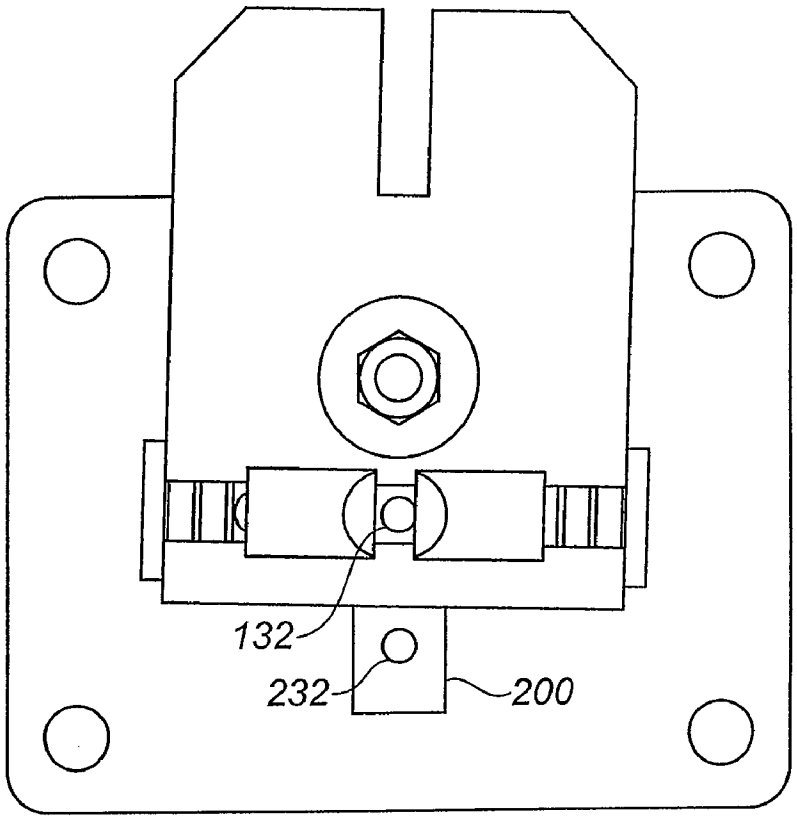
FIGS. 8A and 8B show different views of an alternative embodiment comprising stacked valve units.
Figure 8A:
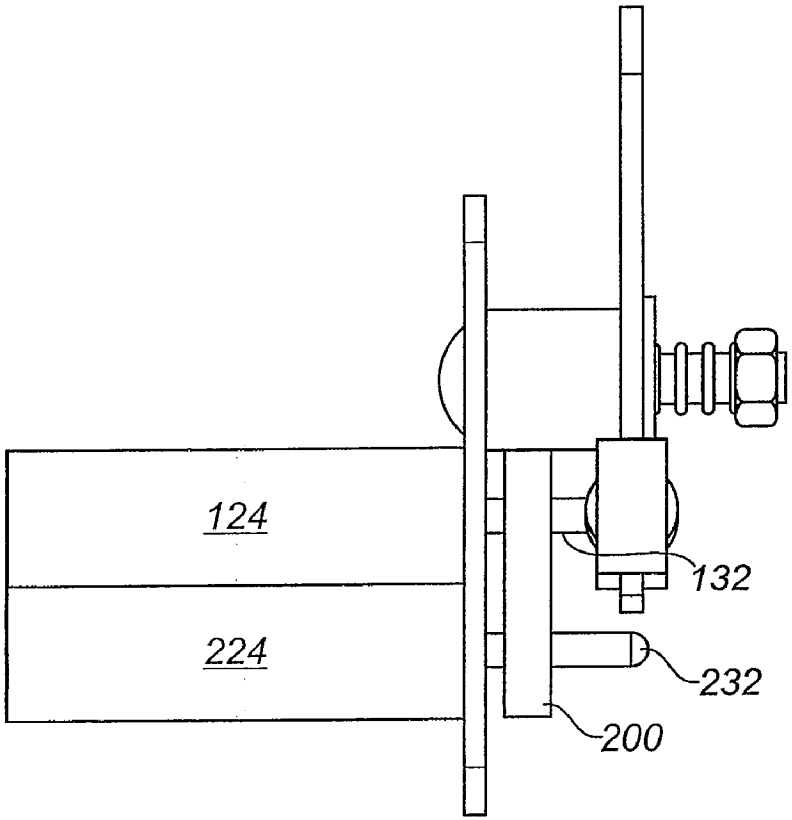

In one alternative embodiment, the two 3-way valve units (124, 224) are stacked, one on top of the other. The first toggle (132) is actuated directly by the pivoting member (40), while the second toggle (232) is actuated by a linker arm (200), as shown in FIGS. 8A and 8B. Although not shown, the second toggle may be spring-actuated by the linker arm (200) in like manner as the spring-loaded means described above.

Figure 9:
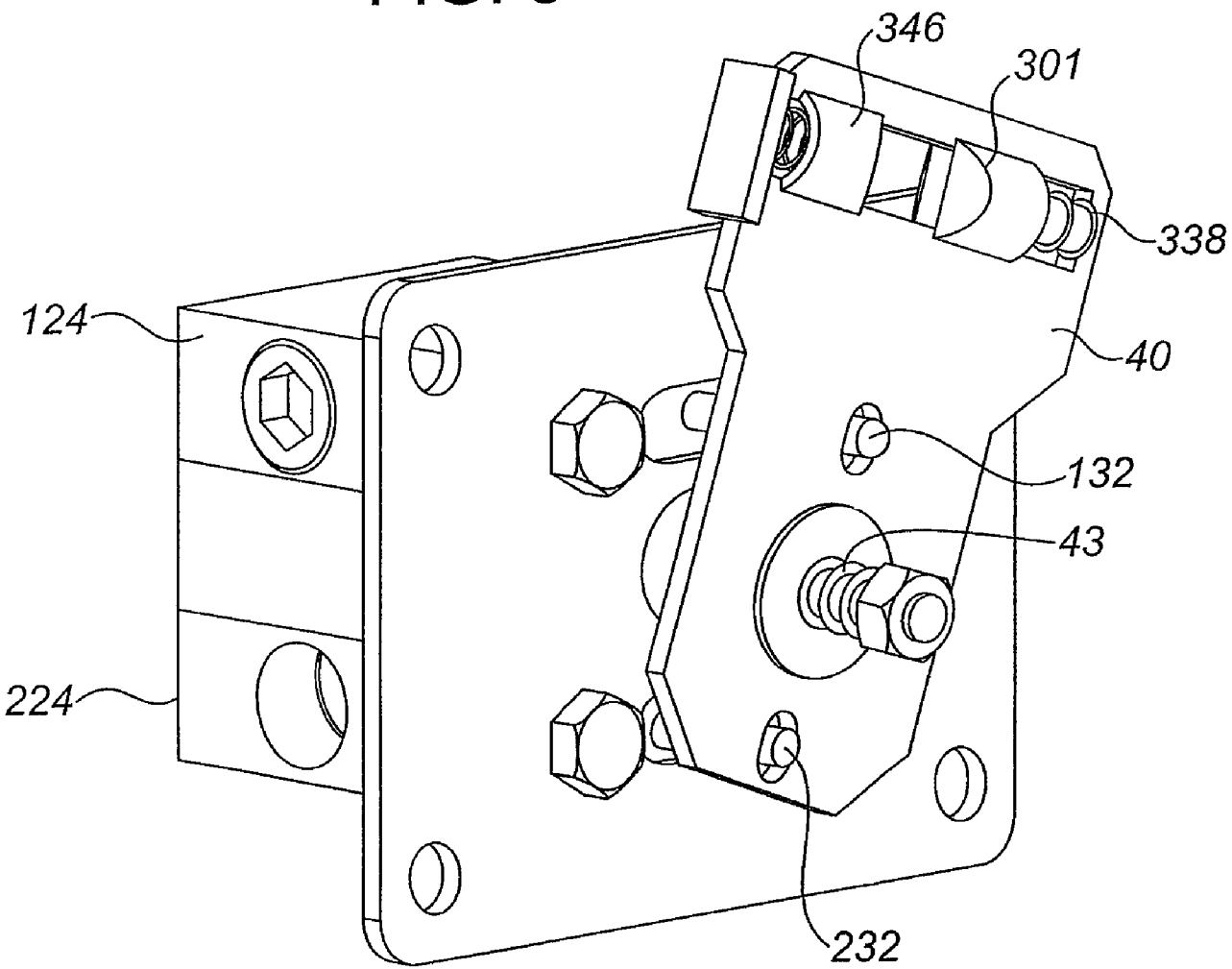
FIG. 9 is a perspective view of another alternative embodiment.

In one embodiment comprising a pair of stacked 3-way valve units (124, 224) having a first toggle (132) and a second toggle (232) respectively, the pivot (43) is disposed between the first and second toggles, as shown in FIG. 9. Thus rotation of pivoting member (40) actuates both first and second toggles in opposite directions. In one embodiment, the spring-actuated means (301) are provided on the pivoting member (40) where it contacts the trigger (34). In one embodiment, sliders (346) are mounted to coil springs (338) such that the trigger (34) is in constant contact with at least one slider (346). In the same manner described above, movement of the trigger will compress the springs (338) and drive the pivoting member in order to actuate the first and second toggles (132, 232).

Figure 10:
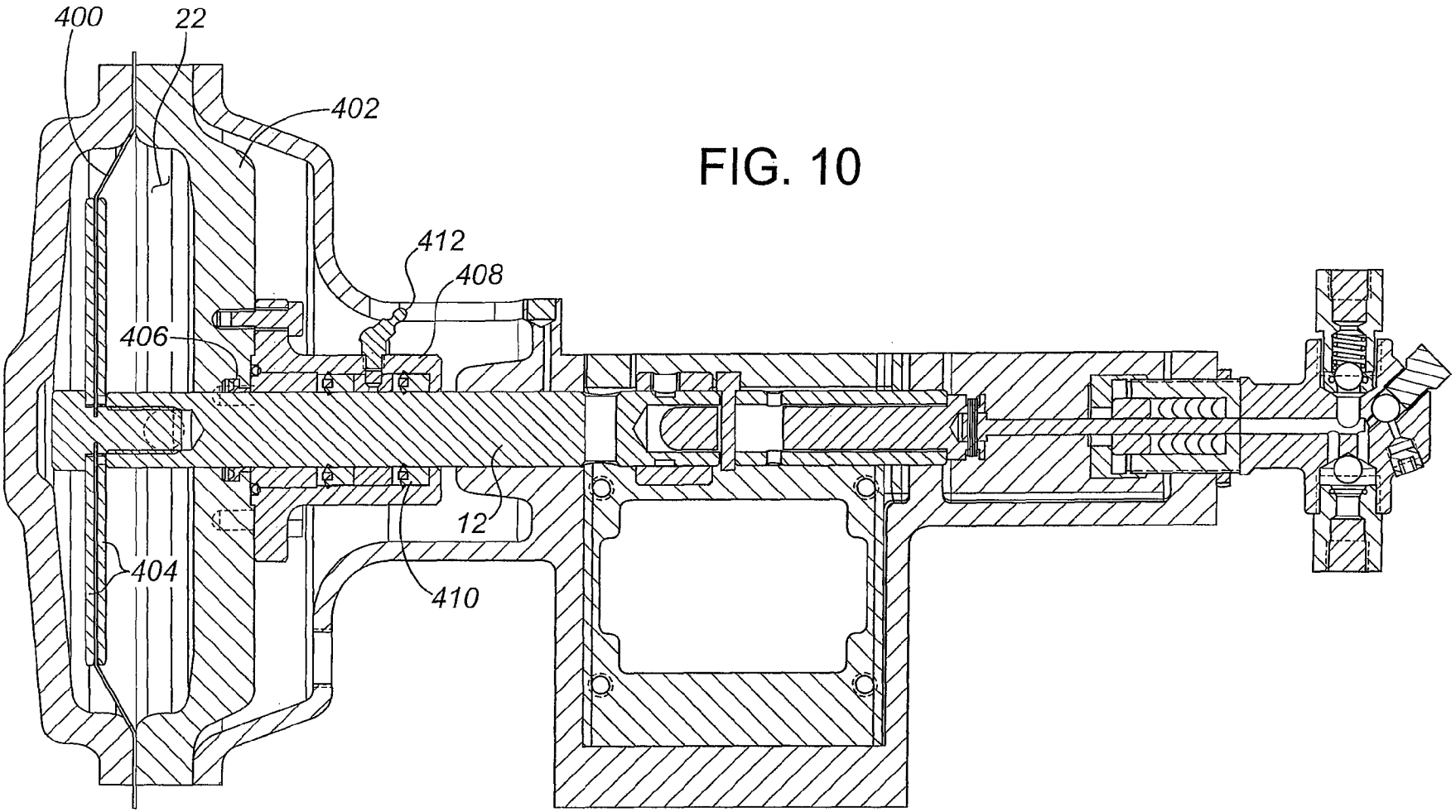
FIG. 10 is a cross-sectional view of a reciprocating device with a seal sub and a double acting diaphragm.

In one embodiment, as shown in FIG. 10, a diaphragm (400) may be retrofitted with a seal plate (402), and diaphragm plates (404) to create a double-acting diaphragm which may be suitable for use with a switching valve of the present invention. The seal plate (402) closes off the second chamber (22) with an engineered seal (406) such as a piston rod lip seal or a Polypak™ seal. In one embodiment, a seal sub (408) may be provided to provide further redundant seals (410) and/or to provide a grease nipple (412) for lubrication of the reciprocating shaft (12).

What is claimed is:

1. A control system for a reciprocating device, the control system comprising:

(a) a switching valve having a fluid supply inlet, an exhaust outlet, a first drive line, and a second drive line, wherein the valve is operable to connect one of the exhaust outlet and the fluid supply inlet to the first drive line and to connect one of the exhaust outlet and the fluid supply inlet to the second drive line;

(b) a toggle for operating the valve, wherein the toggle is movable between a first position in which fluid flow is from the fluid supply inlet to the first drive line, and from the second drive line to the exhaust outlet, and a second position in which fluid flow is from the fluid supply inlet to the second drive line, and from the first drive line to the exhaust outlet;

(c) a reciprocating device that is operable to move in a first direction due to fluid pressure in the first drive line and a second direction opposite the first direction due to fluid pressure in the second drive line;

(d) a trigger disposed on the reciprocating device being operable to move the toggle into the first position when the reciprocating device is moving in the second direction, and to move the toggle into the second position when the reciprocating device is moving in the first direction; and (e) a connector disposed between the toggle and the trigger.

2. The control system of claim 1 wherein the connector comprises a pivoting member.

3. The control system of claim 2 wherein the pivoting member comprises a pair of toggle actuating arms, wherein the first and second biasing means are located on the toggle actuating arms.

4. The control system of claim 1 comprising a pair of switching valves, each actuated by the reciprocating device.

5. The control system of claim 4 wherein the pair of switching valves are stacked, and wherein the means for actuating the toggle comprises a single pivoting member which actuates both switching valves.

6. The control system of claim 5 wherein the pivoting member has a pivot point disposed between the pair of switching valves.

* * * * *